US005697405A

United States Patent [19]

Dornier et al.

[11] Patent Number: 5,697,405

[45] Date of Patent: Dec. 16, 1997

[54] WEFT THREAD INSERTION NOZZLE

[75] Inventors: Peter D. Dornier, Nonnenhorn; Adnan Wahhoud, Lindau-Bodolz, both of Germany

[73] Assignee: Lindauer Dornier Gesellschaft mbH, Lindau, Germany

[21] Appl. No.: 624,796

[22] Filed: Mar. 27, 1996

[30] Foreign Application Priority Data

Mar. 29, 1995 [DE] Germany ..... 195 11 439.6

[51] Int. Cl.[6] ..... D03D 47/30

[52] U.S. Cl. ..... 139/435.4; 28/271

[58] Field of Search ..... 28/271, 272, 273, 28/274, 275, 276; 139/435.4

[56] References Cited

U.S. PATENT DOCUMENTS

| | | | |
|---|---|---|---|
| 4,619,296 | 10/1986 | Hrus et al. | 139/435.4 |
| 4,643,233 | 2/1987 | Manders | 139/435.4 |
| 5,282,779 | 2/1994 | Sakai et al. | 28/276 |
| 5,526,850 | 6/1996 | Sora et al. | 28/273 |

FOREIGN PATENT DOCUMENTS

| | | |
|---|---|---|
| 0239137 | 9/1987 | European Pat. Off. . |
| 0273473 | 7/1988 | European Pat. Off. . |
| 0418948 | 3/1991 | European Pat. Off. . |
| 2550235 | 2/1985 | France . |
| 3527751 | 2/1986 | Germany . |
| 8503440 | 7/1987 | Netherlands . |
| 610366 | 4/1979 | Switzerland . |
| 2085487 | 4/1982 | United Kingdom . |

*Primary Examiner*—Andy Falik

*Attorney, Agent, or Firm*—W. G. Fasse; W. F. Fasse

[57] ABSTRACT

A weft thread insertion nozzle includes a thread supply tube (3) and a mixing tube (8) arranged in axial alignment in a housing (4). An outlet end section (3A) of the thread supply tube (3) reaches into and overlaps an inlet section (8A) of the mixing tube (8), with an airflow channel (5A) provided between the outlet end section (3A) and the inlet section (8A). A plurality of notches (11) or through-holes (13, 14, and 15) are arranged distributed around the circumference of the outlet end section (3A). The jet medium accelerated through the airflow channel (5A) can enter the tube (3) through the notches (11) or holes (13, 14, and 15), whereby the jet medium expands and entrains the weft thread before entering into the mixing tube. By shifting the air expansion and entrainment of the weft thread upstream, turbulence is avoided and the weft thread is more gently and positively entrained so as to improve the performance of the insertion nozzle.

22 Claims, 2 Drawing Sheets

WEFT THREAD INSERTION NOZZLE

FIELD OF THE INVENTION

The invention relates to a method for improving the performance or efficiency of the insertion of the weft thread into the loom shed of an air jet weaving loom, and to a weft insertion nozzle for carrying out the method.

BACKGROUND INFORMATION

It is commonly known in the art to use an air jet insertion nozzle to insert the weft thread into the loom shed of a loom. Published European Patent Specification 0,239,137 describes an adjustable insertion nozzle for an air jet loom, wherein the airflow acceleration can be adjusted. The known insertion nozzle essentially consists of a nozzle housing, a thread supply tube arranged in the housing in an axially slidable or fixed manner, a mixing tube arranged in the housing in an axially slidable or fixed manner in axial extension of the thread supply tube, and an air supply channel for the jet medium concentrically enclosed by the nozzle housing. The air supply channel extends concentrically around the tapered outlet end of the thread supply tube, and ends between the outlet end of the thread supply tube and the tapered inlet end of the mixing tube. The air jet acceleration can be adjusted by moving the thread supply tube and the mixing tube relatively closer together or farther apart to provide a correspondingly smaller or larger flow-through aperture between the outlet end of the thread supply tube and the inlet end of the mixing tube. The entirety of Published European Patent Specification 0,239,137 is incorporated herein by reference to provide background disclosure regarding the known nozzle construction according to the state of the art.

It is generally known in the art that for air jet weft insertion, the application of pulling or tractive force to the weft thread takes place within the mixing tube of the insertion nozzle. In order to influence the airflow characteristics and therewith also influence the application of the tractive force onto the weft thread, the air supply channel is given a cross-section that varies in the flow direction so that the airstream, which is supplied to the insertion nozzle at a specified pressure, is accelerated within the nozzle in the direction of weft insertion. The accelerated airstream thereafter enters into the mixing tube, which has a larger inner cross-section as compared to the acceleration region, so that the airstream expands therein and entrains the weft thread to be inserted into the loom shed.

As a result of the known construction of the air jet nozzle, a sharply stepped expansion of the airstream occurs directly at the area of the transition of the airstream between the thread supply tube and the mixing tube. This sudden, sharply stepped expansion causes flow turbulences in the area between the outlet of the air supply channel and the inlet area of the mixing tube. These airflow turbulences have a negative impact on the structure or flow form of the weft thread and on the entrainment characteristic thereof, i.e. the application of tractive force onto the weft thread. As a result the weft thread flight time across the weaving width is negatively influenced.

While the adjustable nozzle described in the European Publication 0,239,137 aims to allow the weft insertion speed to be adjusted by adjusting the flow-through aperture of the nozzle, the above described negative flow characteristics are not avoided. In other words, even in the adjustable nozzle of European Publication 0,239,137, the accelerated airflow exiting from the air supply channel expands in a sudden, sharply stepped manner, which generates airstream turbulence at the outlet of the air supply channel that continues into the inlet of the mixing tube. The flow turbulence has a negative impact on the structure of the weft thread and on its air jet transport characteristics.

OBJECTS OF THE INVENTION

In view of the above it is the aim of the invention to achieve the following objects singly or in combination:

- to provide a method for gently and smoothly entraining the weft thread and thereby improving the performance of an insertion nozzle of a weaving loom;
- to provide a particular construction of an insertion nozzle for carrying out the above mentioned method;
- to provide a method and an air jet nozzle construction that avoids the sudden and sharply stepped expansion of the airstream forming the air jet, whereby the occurrence of turbulence can be reduced or avoided and the structure or flow form of the weft thread is not disrupted;
- to provide a method and an air jet nozzle construction, wherein the airflow is partially introduced into the thread supply tube in a transition region near its outlet end to provide a smoothly transitioning expansion of the airstream and a smooth application of tractive force to the weft thread; and
- to provide a method and an air jet nozzle construction that achieves an increased tractive force application onto the weft thread as it passes through the nozzle, and an improved feed-in suction at the inlet end of the thread supply tube as compared to prior art methods and nozzle constructions.

SUMMARY OF THE INVENTION

The above objects have been achieved in a method according to the invention, wherein the airstream supplied to the insertion nozzle accelerates in an air supply channel and then expands while entraining the weft thread. More particularly according to the invention, the expansion of the airstream and the tractive pulling or entraining of the weft thread by the airstream takes place before the airflow enters into the mixing tube. The expansion of the airflow preferably takes place in an outlet end section of the thread supply tube, and the airstream continues to expand until it enters into the mixing tube.

The above objects have also been achieved in an air jet insertion nozzle according to the invention comprising a thread supply tube and a mixing tube arranged in substantial axial alignment with each other in a housing, and an air supply channel around the thread supply tube and concentrically enclosed by the housing.

At least either the thread supply tube or the mixing tube is axially movable relative to the other to allow an adjustment of the airstream acceleration. Especially according to the invention, a plurality of openings such as notches of opening such as through-holes are provided distributed around the circumference of an outlet end section of the thread supply tube. These notches or through-holes allow air to flow from the air supply channel into the end section of the thread supply tube, which allows the airstream to expand before transitioning into the mixing tube. The notches or the through-holes preferably provide an increasing total cross-sectional area toward the outlet end of the thread supply tube, to allow an ever-increasing expansion of the airstream.

The method and nozzle construction according to the invention avoid the sudden and sharply stepped expansion of the airstream upon its transition into the mixing tube, by shifting the start of the airstream expansion upstream, and especially by providing a particular construction of the outlet end of the thread supply tube. In this manner, turbulence is reduced or eliminated, and the efficiency and performance of known insertion nozzles, i.e. main nozzles, can be improved. At the same time, the structure or flow-form of the weft thread is not affected.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
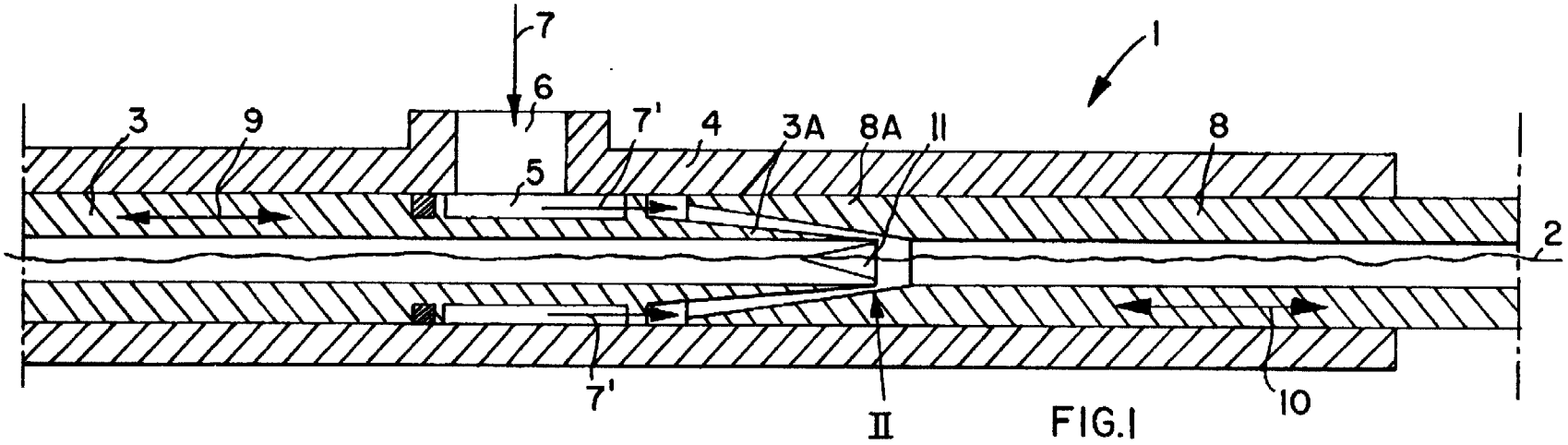
FIG. 1 is a schematic partial lengthwise section through an insertion nozzle according to the invention.
Figure 2:
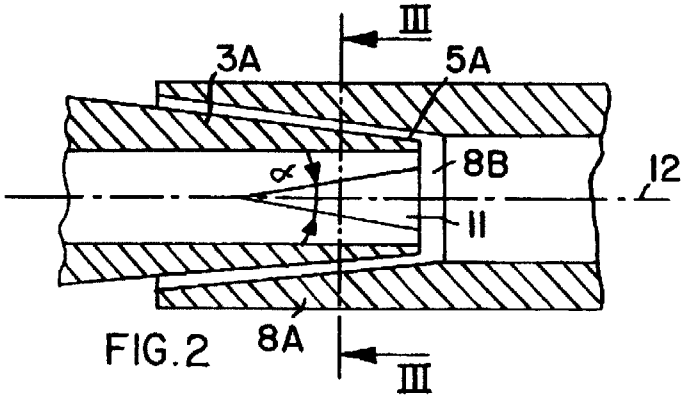
FIG. 2 is an enlarged view of the detail area II of FIG. 1, showing the outlet end section of the thread supply tube with the inlet section of the mixing tube.

In the example embodiment shown in FIG. 1, an insertion nozzle 1 for inserting a weft thread 2 into a loom shed, which is not shown, comprises a thread supply tube 3 and a mixing tube 8 arranged in axial alignment with or extension of the thread supply tube 3 within a nozzle housing 4. An air supply channel 5 concentrically surrounds at least a part of the thread supply tube 3 and is in turn concentrically enclosed by the housing 4. An airstream is provided under pressure to the air supply channel 5 through an air connector stub 6 as shown by arrow 7, and then flows through the air supply channel 5 as shown by arrows 7'. From there, the air flows into and through an airflow channel 5A having an annular cross-section that is formed between the outlet end section 3A of the thread supply tube 3 and the inlet section 8A of the mixing tube 8, as especially shown in FIGS. 2 and 3. The annular airflow channel 5A opens into a circular section airflow channel 8B enclosed within the mixing tube 8.

In order to accelerate the air flow through the airflow channel 5A, i.e. through the overlap region between the outlet end section 3A of the thread delivery tube 3 and the inlet section 8A of the mixing tube 8, the outlet end section 3A has a conical outer shape and the inlet section 8A has a conical inner shape. The conical angle of the outlet section 3A can be the same as the conical angle of the inlet section 8A, but preferably the outlet section 3A has a smaller conical angle than the inlet section 8A. Thereby the airflow channel 5A has an ever-decreasing annular area in the flow direction through the range of overlap between the outlet end section 3A and the inlet section 8A, which causes the airflow to accelerate. It is also within the scope of the present invention that the outlet end section 3A and the inlet section 8A have respective cylindrical shapes.

As shown in FIG. 1, at least either the thread supply tube 3 or the mixing tube 8 is a separable non-integral component relative to the housing 4 and the other of the thread supply tube 3 and the mixing tube 8. Furthermore, at least one, or both of the thread supply tube 3 and the mixing tube 8 are arranged to be axially slidable in the housing 4, as shown by double-headed arrows 9 and 10. By axially sliding one or both of the thread supply tube 3 and the mixing tube 8 relative to each other, the extent of overlap between the outlet end section 3A and the inlet section 8A can be varied to adjust the annular flow-through cross-sectional area of the airflow channel 5A as needed for any particular weaving application. An axial adjustment in this manner provides the desired quantity and acceleration of the airflow.

The cross-sectional area of the circular airflow channel 8B in the mixing tube 8 is larger than the cross-sectional area of the annular airflow channel 5A. For that reason, the airflow in the channel 8B must be expanded relative to the airflow in the channel 5A. In order to effect the air expansion according to the invention, the outlet end section 3A of the thread supply tube 3 includes openings through a tube wall thereof, through which the air can flow into the thread supply tube 3.

Figure 3:
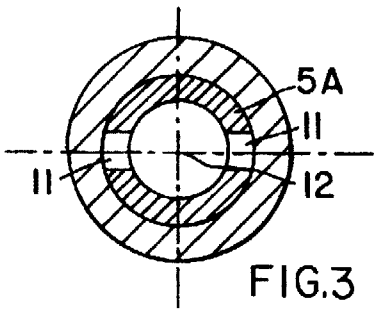
FIG. 3 is a cross-section through the nozzle structure shown in the detail view of FIG. 2, taken along the section line III—III.
Figure 4:
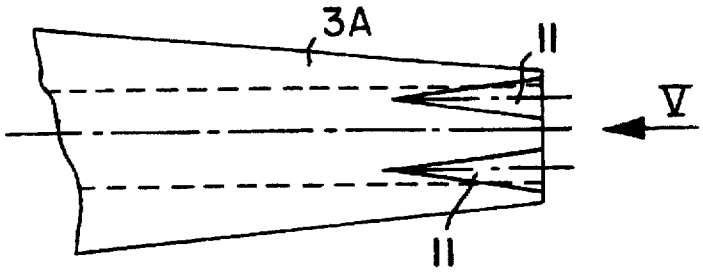
FIG. 4 is a schematic side view of an embodiment of the outlet end section of the thread supply tube having several notches therein.
Figure 5:
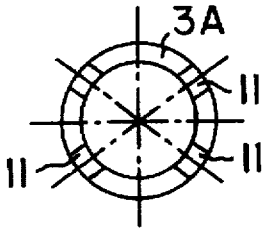
FIG. 5 is an axial end view of the thread supply tube shown in FIG. 4, in the direction of arrow V.

According to a first embodiment, the airflow openings include cut-out notches 11 at the outlet edge of the outlet end section 3A of the thread supply tube 3. The notches 11 are preferably wedge-shaped notches for example, and are preferably distributed about the circumference of the outlet end section 3A and arranged symmetrically about the central axis 12 of the thread supply tube 3. It has been shown to be advantageous for achieving an especially improved weft thread insertion, if the opening angle $\alpha$ (see FIG. 2) of each notch 11 is less than 90°, for example about 20° as shown in the drawings. The outlet end section 3A may have two notches 11 as shown in FIG. 3, or more than two notches 11, for example four notches 11 as shown in FIGS. 4 and 5.

Figure 6:
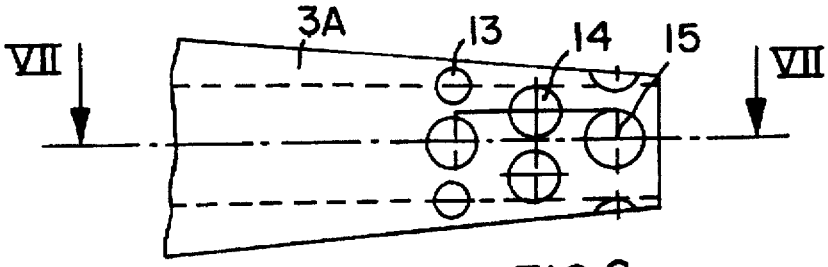
FIG. 6 is a view similar to that of FIG. 4, but showing a different embodiment of the outlet end section of a thread supply tube having several through-holes therein.
Figure 7:
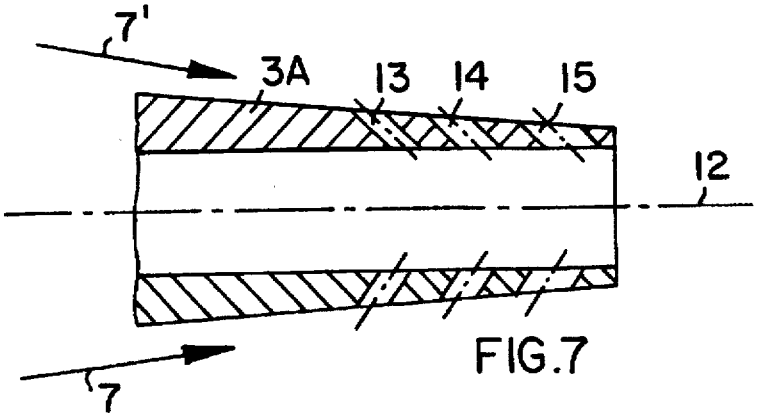
FIG. 7 is a lengthwise section through the thread supply tube of FIG. 6 taken along the section line VII—VII.

FIGS. 6 and 7 show a second embodiment of an outlet end section 3A of the thread supply tube 3 according to the invention. In the present embodiment the airflow openings include through-holes 13, 14 and 15 in the form of through-going bored holes provided in the outlet end section 3A. It is also possible according to the invention to provide notches 11 in combination with through-holes 13, 14 and 15 in the outlet end section 3A. The through-holes 13, 14 and 15 can be provided in a single ring on a single radial plane, but are preferably arranged on several rings around the outlet end section 3A. In this context, it is advantageous if the through-holes 13, 14 and 15 are oriented at a sharp acute angle relative to the central axis 12 of the thread supply tube 3, so that the through-holes 13, 14 and 15 are tilted toward the airflow that passes over the outlet end section 3A in the direction of arrows 7'.

It is further advantageous if the total circumferential cross-sectional area of the notches 11 in the first embodiment and of the rows of through-holes 13, 14 and 15 in the second embodiment increases toward the outlet end of the end section 3A of the thread supply tube 3. For example, the total through-flow area of the first upstream row of holes 13 is less than the total through-flow area of the third downstream row of holes 15. This can be achieved by providing the holes 15 with a larger diameter than the holes 13. It can also be achieved by providing a greater number of holes 15 than holes 13. The preferred wedge or V-shape of the notches 11 readily provides the preferred increasing flow area toward the outlet end.

The operation of the air nozzle according to the method of the invention is as follows. The air supply is provided through the air connector stub 6 at a prescribed pressure potential. From there, the airstream flows into the annular air supply channel 5 and then into the tapering annular airflow channel 5A that is formed with the desired configuration through the adjustable overlapping of the inlet section 8A of the mixing tube 8 and the outlet end section 3A of the thread supply tube 3. In this airflow channel 5A, the airflow is accelerated, and as a result can even reach an ultrasonic speed.

Next, the invention aims to avoid a sudden and sharply stepped expansion of the accelerated airstream in the transition between the tapering annular cross-section of the airflow channel 5A into the open circular cross-section of the airflow channel 8B of the mixing tube 8, and the consequent disadvantageous effects on the weft thread. Instead the invention aims to achieve a gentle expansion of the airflow. In order to achieve this, at least a portion of the airstream flows through the through-holes 13, 14 and 15 or notches 11 into the outlet end section 3A of the thread supply tube 3, whereby the expansion process is at least partially or even totally shifted into the thread supply tube 3. This achieves a more gradual, gentle, and ever-increasing expansion of the airflow through a transition region provided with the notches 11 or openings 13, 14 and 15, and continuing up to the inlet mouth of the airflow channel 8B of the mixing tube 8. As a result, the airflow velocity is reduced and the weft thread is gently entrained by the airflow at an earlier time and at a physical location that is shifted upstream as compared to the prior art.

The inventors have conducted comparative testing of the insertion nozzle according to the invention in contrast to known prior art insertion nozzles, for example according to European Published Patent Specification 0,239,137. The experimental tests have shown that, for an airflow pressure between 1.0 and 6.0 bar, the tractive force applied to the weft thread is about 10% to about 30% higher in the inventive nozzle than in the prior art nozzle, depending upon the ratio between the outer diameter of the outlet end section of the thread supply tube relative to the inner diameter of the inlet section of the mixing tube. Furthermore, the tests have shown that the inventive nozzle guarantees that a suction or vacuum below −100 mbar exists at the inlet of the weft thread supply tube for an airflow initial pressure of 1.0 bar, whereby the threading-in function of the weft thread into the insertion nozzle is reliably ensured.

Further comparative tests showed that significantly shorter weft thread flight times were achieved by using the inventive insertion nozzle as compared to a prior art nozzle for inserting fiber and filament yarns into a loom shed. Moreover, when manufacturing a woven glass material, for example, the machine rotational speed could be increased to 128% of the normal prior art operating speed without negatively influencing the quality of the woven material.

In the comparative tests, the same pressure conditions and other parameters were used for the insertion nozzles according to the invention and according to the prior art.

Although the invention has been described with reference to specific example embodiments, it will be appreciated that it is intended to cover all modifications and equivalents within the scope of the appended claims.

What is claimed is:

1. A method of inserting a weft thread into a shed of an air jet loom having at least one insertion nozzle that includes at least one thread supply tube, one mixing tube, and one air channel, said method comprising:

a) providing an airflow to said air channel and providing said weft thread to said thread supply tube;

b) accelerating said airflow in said air channel;

c) expanding said accelerated airflow, comprising passing at least a portion of said accelerated airflow into said thread supply tube upstream of an outlet end thereof;

d) tractively entraining said weft thread in said expanded airflow; and e) passing said expanded airflow and said entrained weft thread into said mixing tube;

wherein said steps c) and d) occur before said airflow enters said mixing tube in said step e).

2. The method of claim 1, wherein said expanding of said airflow takes place within an outlet end section extending from said outlet end of said thread supply tube.

3. The method of claim 2, wherein said expanding of said airflow continuously increases until said airflow enters said mixing tube in said step e).

4. The method of claim 1, wherein said expanding of said airflow continuously increases until said airflow enters said mixing tube in said step e).

5. The method of claim 1, wherein said step of passing at least a portion of said accelerated airflow into said thread supply tube comprises passing said portion of said airflow into said thread supply tube over an axially extending range of an outlet end section extending from said outlet end of said thread supply tube.

6. The method of claim 5, wherein said step of passing at least a portion of said accelerated airflow into said thread supply tube comprises passing said portion of said airflow into said thread supply tube as a plurality of airstreams through a plurality of openings in a tube wall of said thread supply tube, with said airstreams respectively having a flow cross-section that increases toward a downstream end of said axially extending range.

7. A weft thread insertion nozzle for an air jet loom, said nozzle comprising a housing having an air channel therein, a thread supply tube and a mixing tube arranged substantially axially aligned with each other in said housing, wherein at least one of said thread supply tube and said mixing tube is a separable non-integral component relative to said housing and another of said thread supply tube and said mixing tube, and wherein an outlet end section of said thread supply tube has plural circumferentially distributed openings through a tube wall thereof.

8. The weft thread insertion nozzle of claim 7, wherein at least one of said thread supply tube and said mixing tube is axially movably arranged to provide an adjustable spacing distance between said thread supply tube and said mixing tube.

9. The weft thread insertion nozzle of claim 8, wherein said air channel is arranged concentrically annularly around at least a portion of said thread supply tube and is concentrically enclosed by said housing.

10. The weft thread insertion nozzle of claim 7, wherein said openings communicate said air channel to an interior bore of said outlet end section of said thread supply tube.

11. The weft thread insertion nozzle of claim 7, wherein said openings comprise at least one type of openings selected from the group consisting of plural notches at an outlet end of said thread supply tube and plural through-holes through said tube wall.

12. The weft thread insertion nozzle of claim 11, wherein a cross-sectional area of said openings increases toward said outlet end of said thread supply tube.

13. The weft thread insertion nozzle of claim 11, wherein said openings comprise said notches, and wherein said notches have a wedge-shape that becomes wider toward said outlet end of said thread supply tube.

14. The weft thread insertion nozzle of claim 11, wherein said openings comprise said through-holes, and wherein said through-holes are round-section bored holes.

15. The weft thread insertion nozzle of claim 11, wherein said openings are symmetrically distributed about said circumference.

16. The weft thread insertion nozzle of claim 14, wherein said through-holes are arranged at a plurality of radial planes along said outlet end section.

17. The weft thread insertion nozzle of claim 16, wherein said through-holes at a downstream one of said radial planes nearest said outlet end have larger diameters than said through-holes at an upstream one of said radial planes farthest from said outlet end.

18. The weft thread insertion nozzle of claim 14, wherein said through-holes extend through said tube wall at an acute angle relative to a central axis of said thread supply tube with a vertex of said acute angle toward said outlet end of said thread supply tube.

19. The weft thread insertion nozzle of claim 7, wherein said air channel is adapted to accelerate an airflow passing through said air channel in that said air channel comprises a varying cross-sectional area that diminishes in a flow direction of the airflow toward said outlet end section of said thread supply tube, and said openings through said tube wall are arranged and adapted to pass only a portion of said accelerated airflow from said air channel into said outlet end section of said thread supply tube and thereby expand said accelerated airflow.

20. The weft thread insertion nozzle of claim 7, wherein said mixing tube has an inlet end section that is arranged at an inlet end thereof and that has an inner shape, said outlet end section of said thread supply tube has an outer shape adapted to fit into said inner shape, said thread supply tube and said mixing tube are arranged relative to one another so that said outlet end section extends into said inlet end section to form an overlapping region of said inlet end section at least partially overlapping said outlet end section, and at least a portion of said air channel is formed in said overlapping region between said outer shape of said outlet end section of said thread supply tube and said inner shape of said inlet end section of said mixing tube.

21. The weft thread insertion nozzle of claim 20, wherein said outer shape is conical and tapers toward an outlet end of said outlet end section, and said inner shape is conical and tapers from said inlet end of said mixing tube into said mixing tube.

22. A weft thread insertion nozzle for an air jet loom, said nozzle comprising a housing having an air channel therein, a thread supply tube and a mixing tube arranged substantially axially aligned with each other in said housing, wherein an outlet end section of said thread supply tube has plural circumferentially distributed openings through a tube wall thereof, wherein said openings comprise plural notches arranged at an outlet end of said outlet end section of said thread supply tube, and wherein said notches respectively have a wedge-shape that becomes wider toward said outlet end of said thread supply tube.

* * * * *

UNITED STATES PATENT AND TRADEMARK OFFICE
CERTIFICATE OF CORRECTION

PATENT NO. : 5,697,405

DATED : Dec. 16, 1997

INVENTOR(S) : Dornier et al.

It is certified that error appears in the above-identified patent and that said Letters Patent is hereby corrected as shown below:

Col. 2, line 56, delete "of";
line 57, delete "opening such as", and in its place insert --or--.

Col. 6, line 51, replace "claim 8" by --claim 7--.

Signed and Sealed this

Third Day of March, 1998

*Attest:*

Bruce Lehman

BRUCE LEHMAN

*Attesting Officer*

*Commissioner of Patents and Trademarks*